US009624942B2

(12) United States Patent
Asano et al.

(10) Patent No.: US 9,624,942 B2
(45) Date of Patent: Apr. 18, 2017

(54) TURBO MACHINE

(71) Applicant: IHI Corporation, Tokyo (JP)

(72) Inventors: Nozomu Asano, Tokyo (JP); Shusaku Yamasaki, Tokyo (JP); Toshimichi Taketomi, Tokyo (JP)

(73) Assignee: IHI CORPORATION (JP)

( * ) Notice: Subject to any disclaimer, the term of this patent is extended or adjusted under 35 U.S.C. 154(b) by 329 days.

(21) Appl. No.: 14/561,922

(22) Filed: Dec. 5, 2014

(65) Prior Publication Data

US 2015/0093247 A1 Apr. 2, 2015

Related U.S. Application Data

(63) Continuation of application No. PCT/JP2013/066065, filed on Jun. 11, 2013.

(30) Foreign Application Priority Data

Jun. 11, 2012 (JP) ..... 2012-131785

(51) Int. Cl.
*F04D 17/10* (2006.01)
*F04D 29/26* (2006.01)
(Continued)

(52) U.S. Cl.
CPC ..... *F04D 29/266* (2013.01); *F04D 17/10* (2013.01); *F04D 29/053* (2013.01); *F04D 29/284* (2013.01)

(58) Field of Classification Search
CPC ..... F04D 17/10; F04D 29/053; F04D 29/266; F04D 29/284
See application file for complete search history.

(56) References Cited

U.S. PATENT DOCUMENTS 2,010,525 A 8/1935 McHugh ..... 403/7
4,538,969 A * 9/1985 Ammann ..... F01D 5/025 416/244 A
(Continued)

FOREIGN PATENT DOCUMENTS

CN 101042145 A 9/2007
GB 340450 A 1/1931
(Continued)

OTHER PUBLICATIONS

Chinese Office Action, dated Dec. 25, 2015, issued in corresponding Chinese Patent Application No. 201380030055.0. English translation of Search Report. Total 8 pages.
(Continued)

*Primary Examiner* — Igor Kershteyn
(74) *Attorney, Agent, or Firm* — Ostrolenk Faber LLP

(57) ABSTRACT

The present invention is a turbo machine that is provided with an impeller that is rotated, and with a shaft that transmits rotation power to this impeller, wherein there is provided a differential screw having an impeller screw portion that is provided at one end thereof and that is screwed into the impeller, and having a shaft screw portion that is provided at another end thereof and that is screwed into the shaft, and that fastens the impeller and the shaft together, and wherein, in the differential screw, a thread diameter of thread ridges that are formed on the impeller screw portion is formed the same as a thread diameter of thread ridges that are formed on the shaft screw portion, and a screwing direction of the thread ridges that are formed on the impeller screw portion is formed as the same direction as a screwing direction of the thread ridges that are formed on the shaft screw portion, and a pitch between the thread ridges that are formed on the impeller screw portion is
(Continued)

formed smaller than a pitch between the thread ridges that are formed on the shaft screw portion.

13 Claims, 5 Drawing Sheets

(51) Int. Cl.
*F04D 29/053* (2006.01)
*F04D 29/28* (2006.01)

(56) References Cited

U.S. PATENT DOCUMENTS

| | | | | |
|---|---|---|---|---|
| 4,810,918 | A * | 3/1989 | Kachuk | F04D 29/043 310/87 |
| 6,012,901 | A * | 1/2000 | Battig | F01D 5/025 416/244 A |
| 8,425,189 | B2 * | 4/2013 | Jaeger | F04D 29/20 415/216.1 |

FOREIGN PATENT DOCUMENTS

| | | |
|---|---|---|
| JP | 57-011298 | 1/1982 |
| JP | 05-052356 | 7/1993 |
| JP | 05-057450 | 7/1993 |
| JP | 2002-310121 | 10/2002 |
| JP | 4089802 | 5/2008 |
| JP | 2009-057918 | 3/2009 |
| JP | 4876867 | 2/2012 |
| JP | 2012-077643 | 4/2012 |

OTHER PUBLICATIONS

Japanese Office Action dated Jun. 30, 2015 issued in Japanese Application No. 2014-521345 with an English language translation.

International Search Report and Written Opinion mailed Sep. 10, 2013 in corresponding PCT International Application No. PCT/JP2013/066065.

* cited by examiner

TURBO MACHINE

The present invention relates to a turbo machine. This application is a continuation application based on a PCT Patent Application No. PCT/JP2013/066065, filed Jun. 11, 2013, whose priority is claimed on Japanese Patent Application No. 2012-131785, filed Jun. 11, 2012. The contents of both the PCT Application and the Japanese Application are incorporated herein by reference.

TECHNICAL FIELD

Background Art

Turbo machines such as turbocompressors and turbochargers are provided with an impeller that is rotated as a result of rotation power from a shaft being transmitted to the impeller (Patent Document 1 to Patent Document 4).

In Patent Document 1 and Patent Document 2 a structure is disclosed in which an impeller and a shaft are fastened together by screwing together a male thread and a female thread that are formed on the impeller and the shaft so as to combine them into an impeller rotor.

In Patent Document 3 a structure is disclosed in which, by using a tension bolt, it is possible to firmly fasten an impeller and a shaft together with the impeller essentially not being allowed to perform any rotational movement at all relative to the shaft.

In Patent Document 4, a structure is disclosed in which an impeller and a shaft can be fastened together using a differential screw in which the pitch of the thread portion on the impeller side is different from the pitch of the thread portion on the shaft side.

CITATION LIST

Patent Documents

Patent Document 1: Japanese Unexamined Patent Application, First Publication No. H5-52356
Patent Document 2: Japanese Unexamined Patent Application, First publication No. H5-57450
Patent Document 3: Japanese Patent No. 4876867
Patent Document 4: Japanese Patent No. 4089802

SUMMARY OF INVENTION

Technical Problem

However, in the structure disclosed in Patent Document 1 and Patent Document 2, when an impeller and a shaft are being fastened together, it is necessary to make the impeller perform a rotational movement relative to the shaft. Namely, the impeller has to be brought gradually closer to the shaft at the same time as it is made to perform a rotational movement. Because of this, the amount of movement of the impeller when the impeller is being mounted on the shaft is vastly greater than the amount of movement of the impeller when the impeller is mounted on the shaft without being made to perform a rotational movement. Accordingly, in the technology described in Patent Document 1 and Patent Document 2, a greater amount of work is required when the impeller and the shaft are fastened together.

Moreover, in order to prevent the impeller and the shaft from shifting relative to each other in the rotation direction, it is desirable that adequate friction force be present between the impeller and the shaft. Because of this, when the impeller and shaft are being attached, it is preferable, once the impeller has been placed in contact with a seating surface (i.e., an end surface of the shaft that is placed in contact with the impeller), for the impeller to then be pushed further in the direction of the shaft so that the impeller becomes elastically deformed. However, in the technology described in Patent document 1 and Patent document 2, because friction force is acting between the impeller and the seating surface after the impeller has been placed in contact with the seating surface, there is an increase in friction resistance. Namely, a sizable fastening torque is needed in order to push the impeller in the direction of the shaft.

Moreover, in Patent Document 3, because a tension bolt is used, a complex, large apparatus such as a hydraulic tensioner is additionally required. Moreover, the amount of work (i.e., energy) increases correspondingly to the amount of stretching that is caused by pretensioning.

Furthermore, in Patent Document 4, the problems inherent in Patent Document 1 and Patent Document 2 are solved by using a differential screw, however, the thread diameter of the thread portion that is screwed onto the impeller is different from the thread diameter of the thread portion that is screwed onto the shaft. Because of this, a new problem arises that the length of the differential screw needs to be extended in order to alleviate the stress generated in the portions where the thread diameter is different. Namely, because a step portion having a large-sized step is formed between the portions where the thread diameter is different, there is an increased concentration of stress in this step portion. Accordingly, it is necessary to form the step portion in a comparatively elongated taper shape so as to reduce the stress concentration as much as possible. However, if the length of the differential screw is extended in order to solve this new problem, then in the same way as when the tension bolt described in Patent Document 3 is used, the amount of work increases correspondingly to the amount of stretching that is caused by pretensioning.

The present invention was conceived in view of the above-described circumstances, and it is an object thereof to provide a turbo machine that suppresses any increase in the amount of work that is caused by pretensioning.

Solution to Problem

A first aspect of the present invention is a turbo machine that is provided with an impeller that is rotated, and with a shaft that transmits rotation power to this impeller. The turbo machine includes a differential screw having an impeller screw portion that is provided at one end thereof and that is screwed into the impeller, and having a shaft screw portion that is provided at another end thereof and that is screwed into the shaft, and that fastens the impeller and the shaft together. In the differential screw, a thread diameter of thread ridges that are formed on the impeller screw portion is formed the same as a thread diameter of thread ridges that are formed on the shaft screw portion, a screwing direction of the thread ridges that are formed on the impeller screw portion is formed as the same direction as a screwing direction of the thread ridges that are formed on the shaft screw portion, and a pitch between the thread ridges that are formed on the impeller screw portion is formed smaller than a pitch between the thread ridges that are formed on the shaft screw portion.

A second aspect of the present invention is the turbo machine according to the first aspect, wherein the impeller screw portion is longer than the shaft screw portion.

A third aspect of the present invention is the turbo machine according to the first or second aspects, wherein the impeller is provided with a through hole that extends along the axis of rotation thereof and that screws together with the impeller screw portion of the differential screw, and in an aperture portion of the through hole that is furthest from the shaft, a cover body that blocks off this aperture portion is removably provided.

A fourth aspect of the present invention is the turbo machine according to any one of the first through third aspects, wherein the differential screw is formed from a material having a higher thermal conductivity than the impeller.

A fifth aspect of the present invention is the turbo machine according to the fourth aspect, wherein the impeller is formed from a titanium alloy, and the differential screw is formed from a steel material.

A sixth aspect of the present invention is the turbo machine according to any one of the first through fifth aspects, further includes a rotation suppressing member that suppresses rotational movement of the impeller relative to the shaft.

A seventh aspect of the present invention is the turbo machine according to the sixth aspect, wherein the rotation suppressing members are pin components that take the direction of the axis of rotation of the impeller as their longitudinal direction, and that are engaged in engagement holes that are provided at positions separated from the axis of rotation of the impeller, and in engagement holes that are provided at positions separated from the axis of rotation of the shaft.

An eighth aspect of the present invention is the turbo machine according to the seventh aspect, wherein a plurality of the pin components are arranged equidistantly in a circumferential direction centered on the axis of rotation of the impeller.

A ninth aspect of the present invention is the turbo machine according to the sixth aspect, wherein the rotation suppressing member has: an engagement projection whose external shape when viewed from the direction of the axis of rotation of the impeller is offset from a circular shape, and that is provided in one of the impeller and the shaft protruding in the direction of the axis of rotation; and an engagement hole that is provided in the other one of the impeller and the shaft, and in which the engagement projection is engaged.

A tenth aspect of the present invention is the turbo machine according to the ninth aspect, wherein the engagement projection has a shape whose center of gravity is the axis of rotation.

An eleventh aspect of the present invention is the turbo machine according to any one of the first through tenth aspects, wherein the screwing direction of the thread ridges that are formed on the shaft screw portion is set to a direction that causes the fastening force between the differential screw and the shaft to be increased by the reaction force that is generated when the shaft is rotated.

A twelfth aspect of the present invention is the turbo machine according to any one of the first through eleventh aspects, wherein an engaging hole or an engaging projection with which an engaging portion of the jig that rotates the differential screw is able to be engaged is preferably provided in an end surface of the differential screw on the impeller side thereof, and a through hole that exposes the engaging hole or the engaging projection is preferably provided in the impeller.

A thirteenth aspect of the present invention is the turbo machine according to the twelfth aspect, wherein the engaging hole or the engaging projection with which the engaging portion of the jig that rotates the differential screw is able to be engaged has a shape whose center of gravity is the axis of rotation of the impeller.

Advantageous Effects of the Invention

In the turbo machine of the present invention, an impeller and a shaft are fastened together using a differential screw in which the thread diameter of thread ridges that are formed, in particular, on an impeller screw portion is the same as the thread diameter of thread ridges that are formed on a shaft screw portion. Because of this, it is no longer necessary to extend the length of the differential screw in order to alleviate the stress generated in the portion where the thread diameters are mutually different, as is the case conventionally. Accordingly, it is possible to suppress any increase in the amount of work that is caused by pretensioning.

DESCRIPTION OF EMBODIMENTS

Hereinafter, embodiments of a turbo compressor according to the present invention will be described in detail with reference made to the drawings. Note that in the following drawings, the scale of the respective components has been suitably altered in order to make each component a recognizable size.

Note also that in the following description, a turbo compressor is described as an example of the turbo machine of the present invention. However, the turbo machine of the present invention is not limited to turbo compressors and may also be applied in general to turbo machines that are provided with an impeller and a shaft such as turbochargers and the like.

First Embodiment

Figure 1:
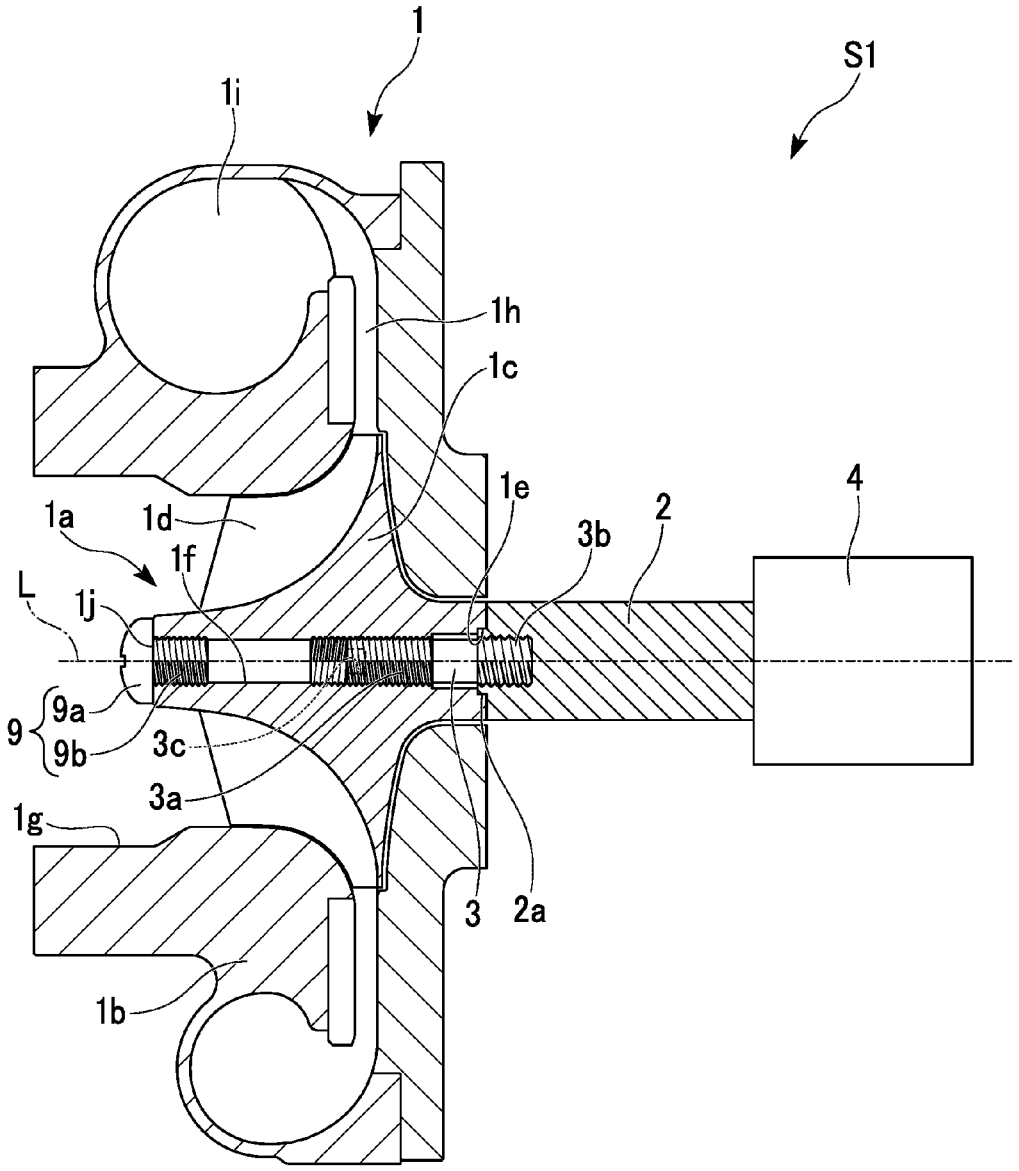
FIG. 1 is a side cross-sectional view showing the schematic structure of a turbo compressor according to a first embodiment of the present invention.

FIG. 1 is a side cross-sectional view showing the schematic structure of a turbo compressor S1 according to a first embodiment of the present invention. The turbo compressor S1 compresses a gas such as air and then expels this as compressed gas and, as is shown in FIG. 1, is provided with a compressor 1, a shaft 2, a differential screw 3, and a drive unit 4.

The compressor 1 is an apparatus that compresses gas as a result of being driven, and is provided with a compressor impeller 1*a* (i.e., the impeller of the present invention), and a compressor housing 1*b*.

The compressor impeller 1*a* is an apparatus that imparts kinetic energy to a gas so as to cause it to accelerate, and is a radial impeller that causes gas that has been suctioned from the direction of an axis of rotation L to accelerate and then expels it in a radial direction. As is shown in FIG. 1, this compressor impeller 1*a* is provided with a base portion 1*c* that is fastened to the shaft 2, and with a plurality of blades 1*d* that are arranged equidistantly in a rotation direction on the surface of the base portion 1*c*.

An engagement hole 1*e* that opens onto the drive unit 4 and engages with an engagement projection 2*a* that is provided on the shaft 2 is formed in the base portion 1*c*. A through hole 1*f* that acts as a housing space to house the differential screw 3 is formed inside the base portion 1*c* such that the through hole 1*f* communicates with the engagement hole 1*e*. A female thread portion (not shown) that is formed by thread grooves inside which a portion on one end side of the differential screw 3 is able to be screwed is formed on an internal wall surface of this housing space.

More specifically, the through hole 1*f* that enables one end surface of the differential screw 3 to be exposed at a distal end of the compressor impeller 1*a* is formed inside the base portion 1*c* so as to extend along the axis of rotation L of the compressor impeller 1*a*. An end portion on the shaft 2 (or on the engagement hole 1*e*) side of this through hole 1*f* forms the housing space that houses the differential screw 3. Accordingly, the through hole 1*f* and the engagement hole 1*e* are placed on the axis of rotation L of the compressor impeller 1*a* such that they are in a continuous straight line configuration.

The through hole 1*f* has a larger internal diameter than a jig 10 described below (see FIG. 2) that is used to rotate the differential screw 3, and the jig 10 can consequently be inserted through the through hole 1*f*.

A female thread portion (not shown) is formed on an internal wall surface on an aperture portion 1*j* side of the through hole 1*f*. This aperture portion 1*j* opens onto a distal end surface (namely, the end surface of the compressor impeller 1*a* that is located on the opposite side from the end surface thereof that is located on the shaft 2 side) of the compressor impeller 1*a*. This female thread portion enables a nose cap (i.e., a cover) 9 that blocks off the aperture portion 1*j* to be screwed into the internal wall surface on the aperture portion 1*j* side of the through hole 1*f*.

The compressor impeller 1*a* that has the above-described type of structure is formed, for example, from a titanium alloy, an aluminum alloy, or a stainless steel alloy in accordance with the gas that is to be compressed.

The compressor housing 1*b* is an apparatus that forms the external shape of the compressor 1, and has a flow path for gas inside it. The compressor housing 1*b* is installed such that it houses the compressor impeller 1*a*.

Moreover, the compressor housing 1*b* is provided with an intake port 1*g* that suctions in gas, a diffuser 1*h* that decelerates and compresses the gas that has been accelerated by the compressor impeller 1*a*, a scroll flow path 1*i* that forms the flow path for the compressed gas, and a discharge port (not shown) from which the compressed gas is discharged.

The shaft 2 is an apparatus that transmits power generated by the drive unit 4 to the compressor impeller 1*a* as rotation power, and is connected to the drive unit 4.

Moreover, the engagement projection 2*a* is formed on one end side of the shaft 2, and this engagement projection 2*a* engages with the engagement hole 1*e* that is formed in the base portion 1*c* of the compressor impeller 1*a*. As a result of the engagement projection 2*a* being engaged in the engagement hole 1*e* in this manner, the compressor impeller 1*a* and the shaft 2 are fixed in position in a radial direction, and are adjusted such that they are positioned on the same axis.

A female thread portion (not shown) into which the portion of the differential screw 3 that is located on the other end side is able to be screwed is formed in the engagement projection 2*a*.

This shaft 2 is formed, for example, from a steel material (for example, a steel material containing chrome and molybdenum).

The differential screw 3 is an apparatus that fastens together the compressor impeller 1*a* and the shaft 2. The differential screw 3 is provided with an impeller screw portion 3*a* that is located on one end side thereof and screws into the compressor impeller 1*a*, and with a shaft screw portion 3*b* that is located on the other end side thereof and screws into the shaft 2.

In this differential screw 3, the thread diameter of the thread ridges that are formed on the impeller screw portion 3*a* is the same as the thread diameter of the thread ridges that are formed on the shaft screw portion 3*b*, and the screwing direction of the thread ridges that are formed on the impeller screw portion 3*a* is the same direction as the screwing direction of the thread ridges that are formed on the shaft screw portion 3*b*.

Furthermore, in the differential screw 3, the pitch of the thread ridges that are formed on the impeller screw portion 3*a* is smaller than the pitch of the thread ridges that are formed on the shaft screw portion 3*b*.

In this way, the thread diameter of the impeller screw portion 3*a* is formed the same as the thread diameter of the shaft screw portion 3*b*. Because of this, this differential screw 3 is different from a conventional differential screw (see Patent document 4), and there is no need to extend the length of the differential screw in order to alleviate the stress generated in the portions where the thread diameter is different. Accordingly, compared with a conventional differential screw, the differential screw 3 can be formed at an acceptably short length.

Moreover, the screwing direction of the thread ridges that are formed on the impeller screw portion 3*a* is the same direction as the screwing direction of the thread ridges that are formed on the shaft screw portion 3*b*. Because of this, as is described below, when the compressor impeller 1*a* and the shaft 2 are being fastened together using this differential screw 3, the compressor impeller 1*a* and the shaft 2 can be fastened together without there being any need to rotate the two relatively to each other.

Furthermore, the pitch of the thread ridges that are formed on the impeller screw portion 3*a* is formed smaller than the pitch of the thread ridges that are formed on the shaft screw portion 3*b*. Because of this, as is described below, by inserting a jig into the through hole 1*f* from the distal end side of the compressor impeller 1*a* and then simply rotating the differential screw 3, the difference between the pitches causes the compressor impeller 1*a* to move closer to the shaft 2. As a consequence, ultimately, the differential screw 3 and the compressor impeller 1*a* are fastened together.

Here, the screwing direction of the thread ridges that are formed on the shaft screw portion 3*b* is set to a direction that causes the fastening force between the differential screw 3 and the shaft 2 to be increased by the reaction force that is generated when the shaft 2 is rotated. As a result, even if an excessive amount of torque is applied between the shaft 2 and the differential screw 3 by this reaction force, this torque does not act in a direction that forces the differential screw 3 away from the shaft 2, but instead acts in a direction to screw the differential screw 3 in towards the shaft 2. Because of this, any loosening of the fastening force between the shaft 2 and the compressor impeller 1*a* is prevented.

In contrast, if an excessive amount of torque is applied between the compressor impeller 1*a* and the differential screw 3 by the reaction force generated when the compressor impeller 1*a* is rotated, then this torque does act in a direction that forces the differential screw 3 away from the compressor impeller 1*a*. However, as is described above, this excessive torque forces the compressor impeller 1*a* to move closer to the shaft 2 due to the aforementioned difference in pitches between the impeller screw portion 3*a* and the shaft screw portion 3*b*. Because of this, any loosening of the fastening force between the shaft 2 and the compressor impeller 1*a* is prevented.

Moreover, in the differential screw 3 of the present embodiment, the impeller screw portion 3*a* is formed longer in the direction of the axis of rotation L than the shaft screw portion 3*b*. The reason for this is that, as is described below, it is necessary to firstly screw the impeller screw portion 3*a* a long way into the compressor impeller 1*a* when the differential screw 3 is being attached between the compressor impeller 1*a* and the shaft 2. In this way, by making the impeller screw portion 3*a* longer than the shaft screw portion 3*b*, the differential screw 3 can be attached in a secure state to the compressor impeller 1*a*.

Moreover, in the differential screw 3 of the present embodiment, an unthreaded portion where thread ridges are not formed is provided between the impeller screw portion 3*a* and the shaft screw portion 3*b*. Note that in order to make it possible for the unthreaded portion to be inserted inside the through hole 1*f* with the aim of attaching the differential screw 3 without having to extend the length of the impeller screw portion 3*a*, when the differential screw 3 is being manufactured, it is necessary for the diameter of the unthreaded portion to be formed smaller than the outermost diameter of the impeller screw portion 3*a* for a length that corresponds to the thread ridges. However, by performing the processing to reduce the diameter of the unthreaded portion separately, then it is sufficient simply for the impeller screw portion 3*a* to be formed longer, and this processing is not difficult. Accordingly, by forming the impeller screw portion 3*a* longer than the shaft screw portion 3*b*, manufacturing costs can be kept in check.

An engaging hole 3*c* is formed in one end surface (i.e., the surface on the compressor impeller 1*a* side) of the differential screw 3, and this engaging hole 3*c* is able to engage with an engaging portion (not shown) of the jig 10 that is used to rotate the differential screw 3. This engaging hole 3*c* is set in a shape (for example, a regular hexagon shape) whose center of gravity is the axis of rotation L when viewed from the direction of the axis of rotation L. As a result, because a balanced weight distribution centered on the axis of rotation L can be maintained for the compressor impeller 1*a* when the compressor impeller 1*a* is rotating, the compressor impeller 1*a* can be made to rotate with stability. Note that one end surface of the differential screw 3 is exposed to the outside of the through hole 1*f* via the through hole 1*f* that, as is described above, is formed in the base portion 1*c* of the compressor impeller 1*a*. Because of this, the engaging hole 3*c* that is formed in the one end surface of the differential screw 3 is also exposed to the outside of the through hole 1*f*.

Moreover, because the differential screw 3 must be able to provide the necessary rigidity to fasten the compressor impeller 1*a* and the shaft 2 together, it is preferable for the differential screw 3 to be made from a material having a higher thermal conductivity than the compressor impeller 1*a*.

Specifically, it is preferable, for example, for the compressor impeller 1*a* to be formed from a titanium alloy, and for the differential screw 3 to be formed from a steel material.

In this way, by forming the differential screw 3 from a material having a higher thermal conductivity than the compressor impeller 1*a*, heat propagation from the compressor impeller 1*a*, which has been highly-heated by the gas compression, to the shaft 2 can be facilitated, and heat can be transferred swiftly to a lubricant that is cooled by a cooling mechanism (not shown).

Moreover, if the differential screw 3 is formed from a steel material and the compressor impeller 1*a* is formed from a titanium alloy, then the thermal expansion of the differential screw 3 is greater than the thermal expansion of the compressor impeller 1*a*. Because of this, if the temperature of the fastening portion where the compressor impeller 1*a* is fastened to the shaft 2 becomes too hot, then as a result of the thermal expansion of the differential screw 3 being greater than that of the compressor impeller 1*a*, in particular, there is a possibility of the compressor impeller 1*a* separating from the shaft 2. However, because it is possible for the thermal expansion to be reduced if the temperature change of the fastening portion can be minimized by cooling that is based on facilitating the heat transfer using the differential screw 3, as has been described above, it is possible to prevent the compressor impeller 1*a* and the shaft 2 from separating. As a consequence, it is possible to prevent any loosening of the fastening force between, for example, the compressor impeller 1*a* and the differential screw 3.

Note that in the present embodiment, because the differential screw 3 and the compressor impeller 1*a* are screwed together, and the differential screw 3 and the shaft 2 are screwed together, the contact surface area between the differential screw 3 and the compressor impeller 1*a*, and the contact surface area between the differential screw 3 and the shaft 2 are increased. Accordingly, because the heat transfer surface area also increases, the aforementioned heat transfer is facilitated even more.

The drive unit 4 is an apparatus that generates power to rotate the compressor impeller 1*a* and transmits the power to the shaft 2, and is provided, for example, with a motor and gears.

The nose cap 9 of the through hole 1*f* that blocks off the aperture portion 1*j* that is formed in the distal end surface of the compressor impeller 1*a* is provided with a semispherical cap body 9*a*, and with a male thread portion 9*b*. An engaging portion (not shown) that engages with a jig that is used to rotate the nose cap 9 is formed in the cap body 9*a*. The cap body 9*a* covers the aperture portion 1*j* when the male thread portion 9*b* is screwed into a female thread portion (not shown) that is formed on the aperture portion 1*j* side of the through hole 1*f*. By doing this, the nose cap 9 is removably attached to the aperture portion 1*j* of the through hole 1*f*, and blocks off the aperture portion 1*j*. Note that when this nose cap 9 is being attached, it is preferable for an O-ring (not shown) to be fitted around the male thread portion 9*b*, and for an O-ring to be interposed between the periphery of the aperture portion 1*j* and the cap body 9*a*, so that the air-tightness between the nose cap 9 and the compressor impeller 1*a* is increased.

Here, the screwing direction of the thread ridges that are formed on the male thread portion 9*b* of the nose cap 9 is set to a direction in which the fastening force between the male thread portion 9*b* and the compressor impeller 1*a* is increased by the reaction force generated when the compressor impeller 1*a* is rotated. By doing this, even if excessive torque is applied between the nose cap 9 and the compressor impeller 1*a* by the reaction force generated when the compressor impeller 1*a* is rotated, this torque does not act in a direction in which the nose cap 9 is forced away from the compressor impeller 1*a*, but instead acts in the direction in which the nose cap 9 is screwed into the through hole 1*f*. Because of this, any loosening of the fastening force between the nose cap 9 and the compressor impeller 1*a* is prevented.

When the turbo compressor S1 of the present embodiment which has the above-described structure is assembled, in order to fasten together the compressor impeller 1*a* and the shaft 2, firstly, the impeller screw portion 3*a* of the differential screw 3 is screwed into the portion of the through hole 1*f* of the compressor impeller 1*a* that is linked to the shaft 2. At this time, the entire impeller screw portion 3*a*, which is formed longer than the shaft screw portion 3*b*, is screwed into the housing space in the through hole 1*f*.

Next, a distal end portion of the shaft screw portion 3*b* that is protruding from the through hole 1*f* is screwed a little way into the female thread portion that is provided in the shaft 2.

Figure 2:
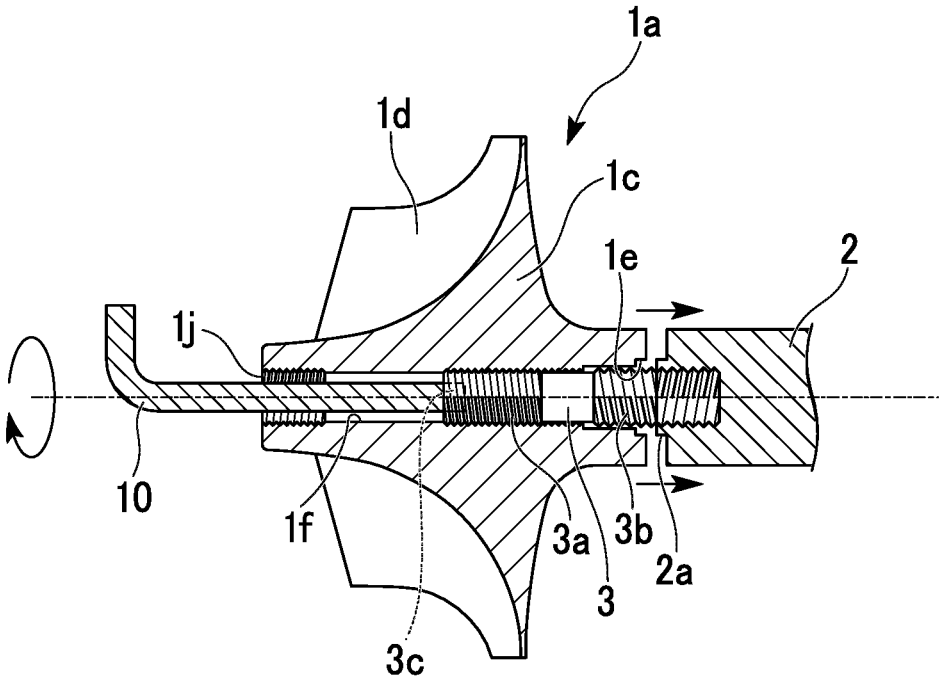
FIG. 2 is a typical view illustrating a task of fastening together a compressor impeller and a shaft that are provided in the turbo compressor according to the first embodiment of the present invention.

Next, as is shown in FIG. 2, the jig 10 (i.e., a hexagonal wrench) is inserted into the through hole 1*f* that is formed in the base portion 1*c* of the compressor impeller 1*a*, and the engaging portion that is located at a distal end of the jig 10 is engaged in the engaging hole 3*c* that is exposed from the through hole 1*f*. The jig 10 is then rotated so as to cause the differential screw 3 to be rotated.

As a result of this, the compressor impeller 1*a* can be made to move closer to the shaft 2 without the compressor impeller 1*a* being made to perform a rotational movement towards the shaft 2, but by moving in a straight line along the axis of rotation L. This is due to the fact that the screwing direction of the thread ridges of the impeller screw portion 3*a* is the same direction as the screwing direction of the thread ridges of the shaft screw portion 3*b*, and also to the fact that the pitch of the thread ridges of the impeller screw portion 3*a* is smaller than the pitch of the thread ridges of the shaft screw portion 3*b*. Consequently, by engaging the engagement projection 2*a* in the engagement hole 1*e*, and then rotating the differential screw 3 until the compressor impeller 1*a* is seated tightly against the shaft 2, the compressor impeller 1*a* is firmly fastened to the shaft 2.

In the turbo compressor S1 of the present embodiment, the compressor impeller 1*a* and the shaft 2 are fastened together using the differential screw 3 in which the thread diameter of the thread ridges that are formed on the impeller screw portion 3*a* is the same as the thread diameter of the thread ridges that are formed on the shaft screw portion 3*b*. Because of this, it is no longer necessary to extend the length of the differential screw 3 in order to alleviate any stress arising in the portion where the thread diameters are mutually different, as is the case conventionally. Accordingly, it is possible to suppress any increase in the amount of work that is caused by pretensioning.

Moreover, in the turbo compressor S1 of the present embodiment, by causing the compressor impeller 1*a* to move in a straight line towards the shaft 2 due to the difference in pitches between the impeller screw portion 3*a* and the shaft screw portion 3*b*, the compressor impeller 1*a* and the shaft 2 are fastened together ultimately by the differential screw 3. Because of this, the compressor impeller 1*a* and the shaft 2 can be fastened together solely by the friction force that is generated on the surface of the shaft 2 where the thread is formed, without any friction force being generated by the rotation of the compressor impeller 1*a* on the seating surface of the shaft 2 (i.e., the end surface of the shaft that comes into contact with the impeller). Accordingly, it is possible to reduce the torque required for the fastening, and thereby decrease the amount of work needed to achieve the fastening.

Moreover, in the turbine compressor S1 of the present embodiment, the compressor impeller 1*a* and the shaft 2 can be fastened together without a huge amount of tension needing to be applied, as in the case when a tension bolt is used for the differential screw 3. Because of this, the compressor impeller 1*a* and the shaft 2 can be fastened together without a complex, large apparatus such as a hydraulic tensioner being additionally required.

Moreover, in the turbine compressor S1 of the present embodiment, the female thread is formed in an area of the internal wall portion of the through hole 1*f* that is provided inside the compressor impeller 1*a*, and the area corresponds to the maximum diameter portion of the compressor impeller 1*a* which is where the load is greatest as a result of the stress being highest in the internal wall portion (i.e., the maximum stress portion). However, because the pitch of this female thread is small so as to correspond to the impeller screw portion 3*a*, which also has a small pitch, it is difficult for stress to be generated in a circumferential direction, so that this portion has improved durability.

Moreover, in the turbine compressor S1 of the present embodiment, because the pitch of the thread ridges of the impeller screw portion 3*a* is smaller than the pitch of the thread ridges of the shaft screw portion 3*b*, a contact surface area between the thread ridges and the through hole 1*f* is increased in the impeller screw portion 3*a*. Accordingly, heat is able to dissipate easily from the impeller maximum diameter portion which is where the temperature is highest (i.e., which is the maximum temperature portion).

Moreover, in the turbine compressor S1 of the present embodiment, because the distance that the compressor impeller 1*a* is moved forward each time the differential screw 3 is rotated a single turn is only small, the torque required for this movement can be reduced.

Moreover, in the turbine compressor S1 of the present embodiment, the differential screw 3 is formed such that the impeller screw portion 3*a* is longer than the shaft screw portion 3*b*. Because of this, when the differential screw 3 is attached between the compressor impeller 1*a* and the shaft 2, the impeller screw portion 3*a* can be screwed in a long way initially into the compressor impeller 1*a*. Accordingly, the differential screw 3 can be attached in a stable state to the compressor impeller 1*a*.

Moreover, in the turbine compressor S1 of the present embodiment, the nose cap 9 is removably attached to the aperture portion 1*j* of the through hole 1*f* so as to block off the aperture portion 1*j*. As a result of this, because moisture and foreign matter are unable to enter the inside of the through hole 1*f*, it is possible to prevent the differential screw 3 becoming rusted because of moisture, and to prevent the differential screw 3 being damaged by foreign matter.

Namely, when it is necessary to remove the differential screw 3 from the compressor impeller 1*a* and the shaft 2 in order to perform maintenance or the like, it is possible to avoid a situation in which the differential screw 3 cannot be removed. Accordingly, because it is possible to improve the durability of the differential screw 3, for example, a comparatively low-cost material can be used for the differential screw 3.

Moreover, in the turbine compressor S1 of the present embodiment, the screwing direction of the thread ridges that are formed on the shaft screw portion 3*b* is set to a direction in which the fastening force between the differential screw 3 and the shaft 2 is increased by the reaction force that is generated when the shaft 2 is rotated. As a result, even if an excessive amount of torque is applied between the shaft 2 and the differential screw 3 by this reaction force, this torque does not act in a direction in which the differential screw 3 is moved away from the shaft 2, but acts in a direction in which the differential screw 3 is screwed in towards the shaft 2. Because of this, any loosening of the fastening force between the shaft 2 and the compressor impeller 1*a* is prevented.

Moreover, in the turbine compressor S1 of the present embodiment, an engaging hole 3*c* in which an engaging portion of the jig 10 that rotates the differential screw 3 is able to be engaged is provided in an end surface of the differential screw 3 on the compressor impeller 1*a* side thereof, and the through hole 1*f* that exposes the engaging hole 3*c* is provided in the compressor impeller 1*a*. Because of this, by inserting the jig 10 into the through hole 1*f*, the differential screw 3 can be easily rotated using the engagement between the engaging portion of the jig 10 and the engaging hole 3*c*.

Moreover, in the turbine compressor S1 of the present embodiment, the compressor impeller 1*a* and the shaft 2 are fastened together by the differential screw 3. Because of this, it is not necessary to extend the shaft 2 as far as the distal end of the compressor impeller 1*a* in order to fix the compressor impeller 1*a*, as is the case in a conventional turbo machine. As a result, the shaft 2 can be shortened so that the rigidity of the shaft 2 can thereby be increased.

Second Embodiment

Next, a second embodiment of the present invention will be described. Note that in the description of the second embodiment, portions that are the same as in the first embodiment are either not described or the description thereof is simplified.

Figure 3A:
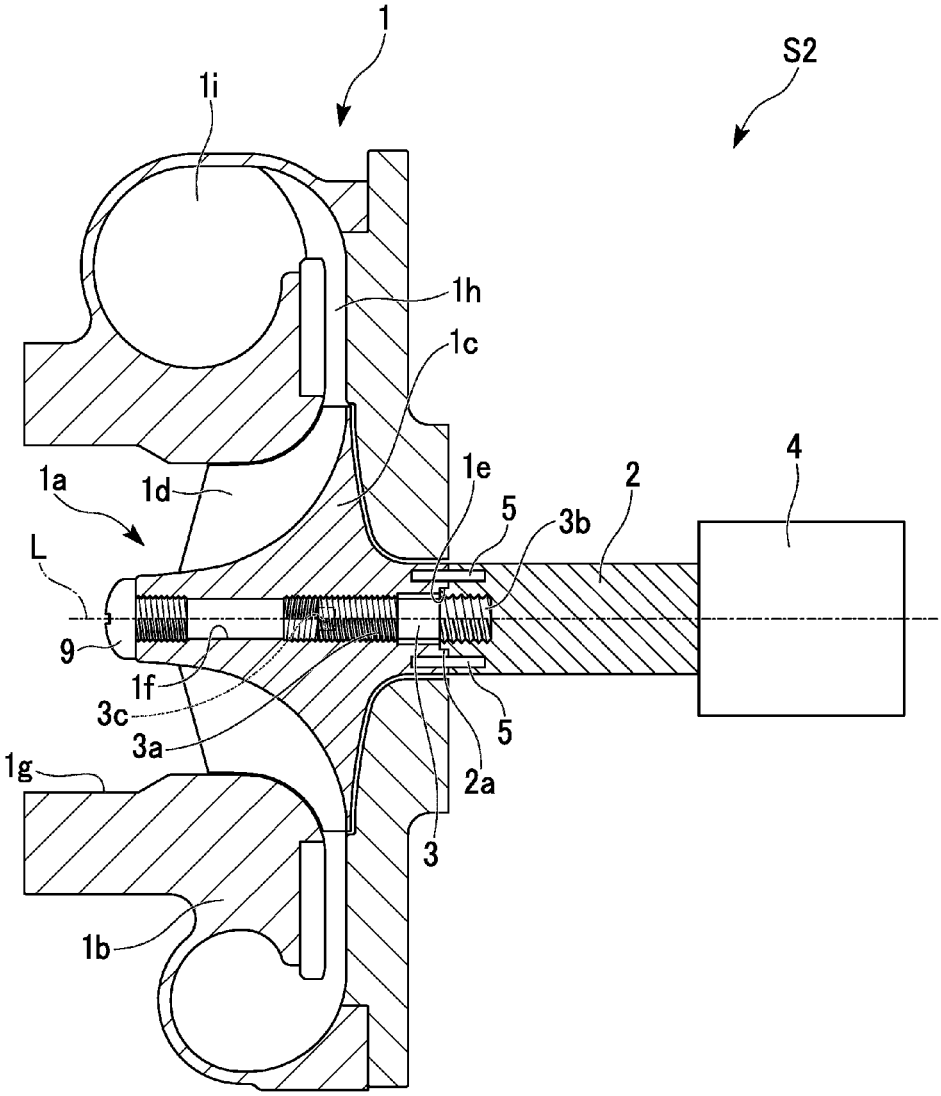
FIG. 3A is a side cross-sectional view showing the schematic structure of a turbo compressor according to a second embodiment of the present invention.
Figure 3B:
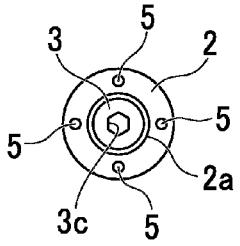
FIG. 3B is a frontal view showing the schematic structure of the turbo compressor according to the second embodiment of the present invention.

FIGS. 3A and 3B are views showing the schematic structure of a turbo compressor S2 of the present embodiment, with FIG. 3A being a side cross-sectional view, and FIG. 3B being a frontal view of the shaft 2 as seen from the direction of the axis of rotation L.

As is shown in FIGS. 3A and 3B, the turbo compressor S2 of the present embodiment is provided with pin components 5 that take the direction of the axis of rotation L as their longitudinal direction, and that are engaged in engagement holes (not shown) that are provided at positions separated from the axis of rotation L of the compressor impeller 1*a*, and in engagement holes (not shown) that are provided at positions separated from the axis of rotation L of the shaft 2.

The pin components 5 are used to suppress the rotational movement of the compressor impeller 1*a* relative to the shaft 2, and function as the rotation suppressing member of the present invention.

In addition, in the turbo compressor S2 of the present invention, as is shown in FIG. 3B, a plurality (four in the present embodiment) of pin components 5 are arranged equidistantly in a circumferential direction centered on the axis of rotation L of the compressor impeller 1*a*. Note that the number of the plurality of pin components 5 is not necessarily limited to four and it is sufficient if they are provided so as to satisfy the above-described arrangement conditions.

According to the turbo compressor S2 of the present embodiment that has the above-described structure, when the compressor impeller 1*a* is being attached to the shaft 2, any rotation of the compressor impeller 1*a* relative to the shaft 2 can be suppressed by the pin components 5. Accordingly, the compressor impeller 1*a* and the shaft 2 can be fastened together in a stable state without any rotation.

Moreover, because the pin components 5 can be made to function as reinforcing members in those locations where the compressor impeller 1*a* and the shaft 2 are joined together, it is possible to improve the strength of the join locations between the compressor impeller 1*a* and the shaft 2.

Note that according to the turbo compressor S2 of the present embodiment, when the compressor impeller 1*a* and the shaft 2 are being fastened together, the pin components 5 are made to engage with one of the compressor impeller 1*a* and the shaft 2, and by then rotating the differential screw 3, the compressor impeller 1*a* is brought closer to the shaft 2 so that the pin components 5 are engaged with the other one of the compressor impeller 1*a* and the shaft 2.

Because of this, it is not possible to utilize the pin components 5 in the conventional fastening method in which the compressor impeller 1*a* is made to perform a rotational movement relative to the shaft 2 when the compressor impeller 1*a* and the shaft 2 are being fastened together.

In other words, the turbo compressor S2 of the present embodiment is able to achieve the effect of improving the strength in the join locations where the compressor impeller 1*a* and the shaft 2 are joined together. In contrast, in a turbo compressor which utilizes the conventional fastening method in which the compressor impeller 1*a* is made to perform a rotational movement relative to the shaft 2, this type of effect cannot be achieved.

Moreover, in the turbo compressor S2 of the present embodiment, the plurality of pin components 5 are arranged equidistantly in a circumferential direction centered on the axis of rotation L of the compressor impeller 1*a*. Because of this, when the compressor impeller 1*a* is rotated, a balanced weight distribution in a rotation direction centered on the axis of rotation L can be maintained for the compressor impeller 1*a*. Accordingly, the compressor impeller 1*a* can be rotated stably.

Third Embodiment

Next, a third embodiment of the present invention will be described. Note that in the description of the third embodiment as well, portions that are the same as in the first embodiment are either not described or the description thereof is simplified.

Figure 4A:
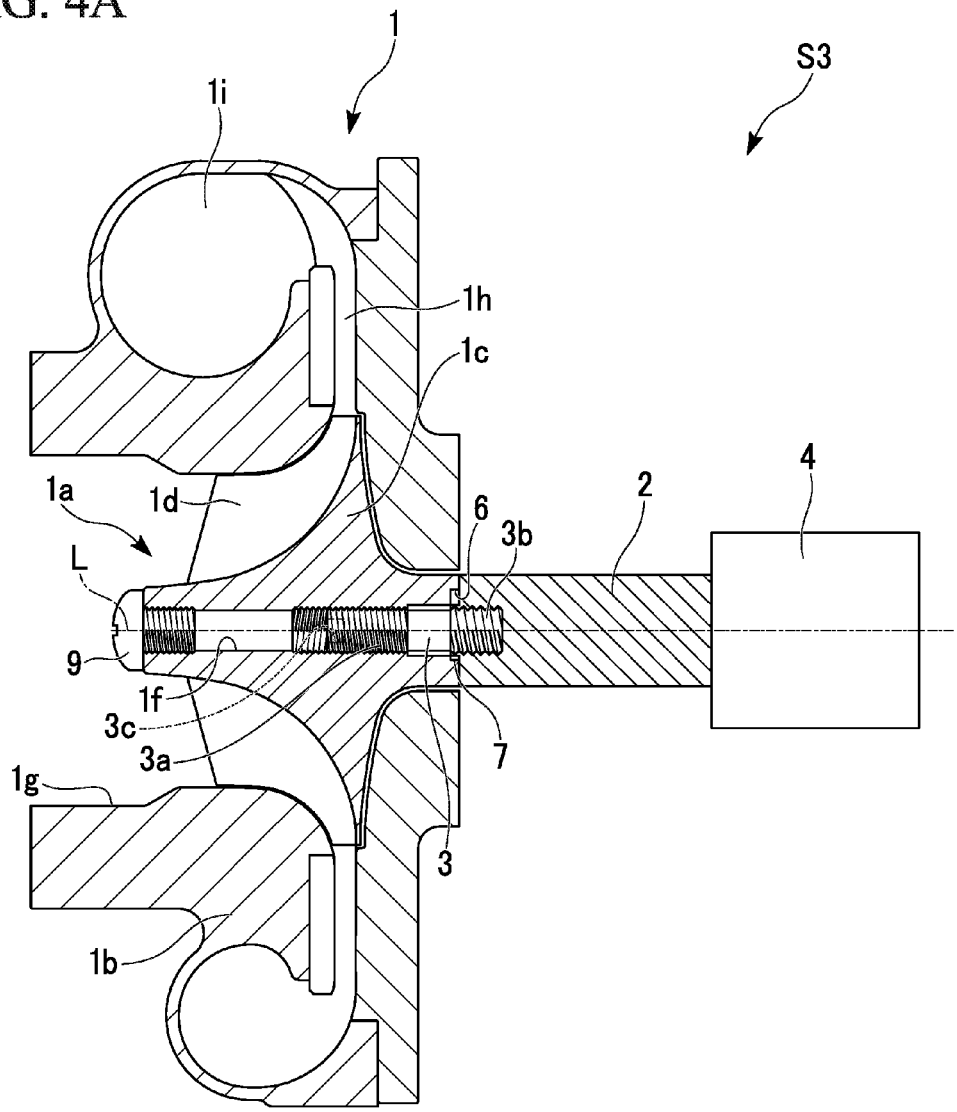
FIG. 4A is a side cross-sectional view showing the schematic structure of a turbo compressor according to a third embodiment of the present invention.
Figure 4B:
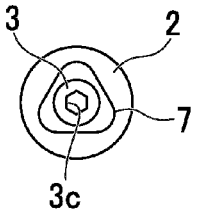
FIG. 4B is a frontal view showing the schematic structure of the turbo compressor according to the third embodiment of the present invention.

FIGS. 4A and 4B are views showing the schematic structure of a turbo compressor S3 of the present embodiment, with FIG. 4A being a side cross-sectional view, and FIG. 4B being a frontal view of the shaft 2 as seen from the direction of the axis of rotation L.

As is shown in FIGS. 4A and 4B, the shape of the turbo compressor S3 of the present embodiment when viewed from the direction of the axis of rotation L of the compressor impeller 1*a* is substantially triangular with the respective apex points rounded off (i.e., so as to form a shape that is offset from a circle), and the turbo compressor S3 of the present embodiment is provided with an engagement projection 7 whose center of gravity is the axis of rotation L, and with an engagement hole 6 in which the engagement projection 7 is engaged.

When the engagement projection 7 and the engagement hole 6 are engaged together, they suppress the rotational movement of the compressor impeller 1*a* relative to the shaft 2. Accordingly, the engagement projection 7 and the engagement hole 6 function as the rotation suppressing member of the present invention.

Note that in the turbo compressor S3 of the present embodiment, the engagement projection 7 is provided on the shaft 2, while the engagement hole 6 is provided in the compressor impeller 1*a*.

However, it is also possible to employ a structure in which, conversely, the engagement projection 7 is provided on the compressor impeller 1*a*, and the engagement hole 6 is provided in the shaft 2.

According to the turbo compressor S3 of the present embodiment that has the above-described structure, when the compressor impeller 1*a* is being attached to the shaft 2, any rotation of the compressor impeller 1*a* can be suppressed by the engagement projection 7 and the engagement hole 6. Accordingly, the compressor impeller 1*a* and the shaft 2 can be fastened together in a stable state without any rotation.

Moreover, in the turbo compressor S3 of the present embodiment, the engagement projection 7 is shaped such that its center of gravity is the axis of rotation L. Because of this, when the compressor impeller 1*a* is rotated, a balanced weight distribution in a rotation direction centered on the axis of rotation L can be maintained for the compressor impeller 1*a*. Accordingly, the compressor impeller 1*a* can be rotated stably.

While preferred embodiments of the invention have been described and illustrated above, it should be understood that these are exemplary of the invention and are not to be considered as limiting. Additions, omissions, substitutions, and other modifications can be made without departing from the scope of the present invention. Accordingly, the invention is not to be considered as limited by the foregoing description and is only limited by the scope of the appended claims.

For example, in the embodiments of the present invention, the engagement projection 2*a* is provided on the shaft 2, while the engagement hole 1*e* is provided in the compressor impeller 1*a*.

Figure 5:
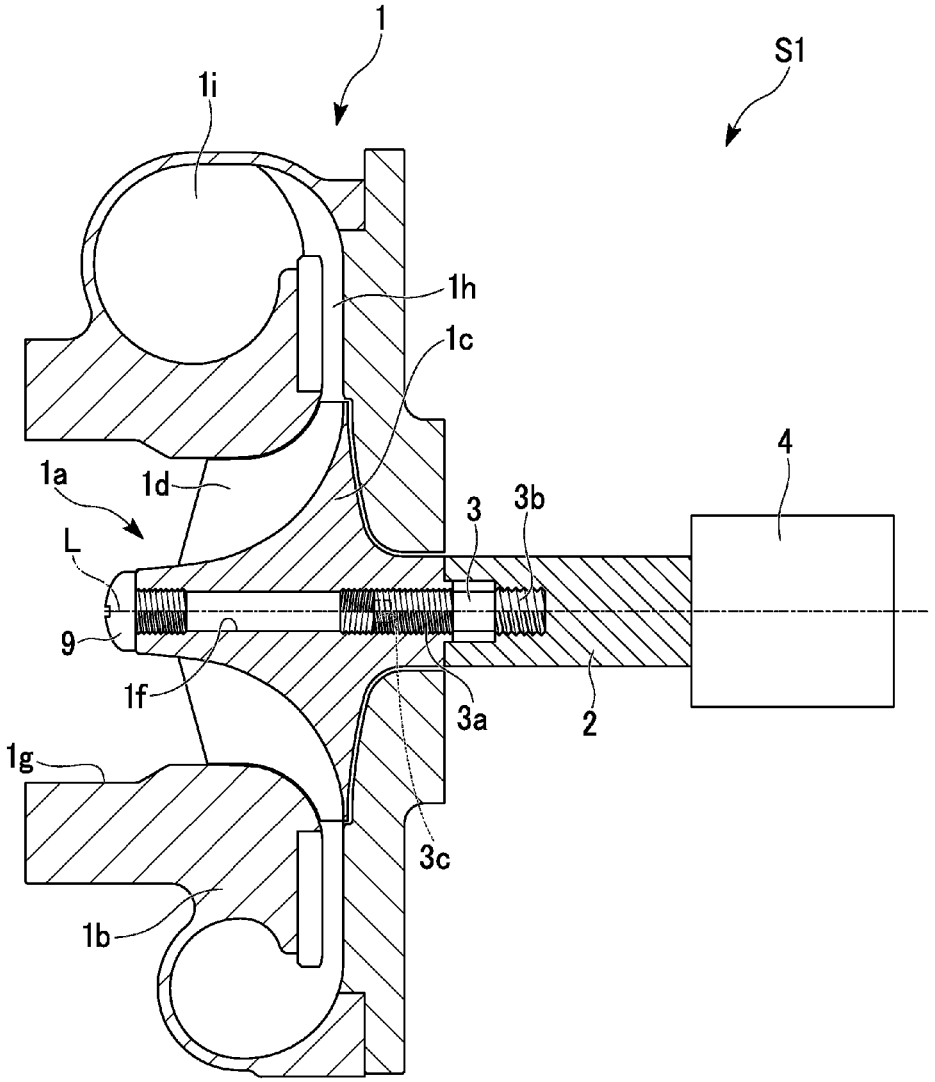
FIG. 5 is a cross-sectional view showing a variant example of the turbo compressor according to the first embodiment of the present invention.

However, as is shown in FIG. 5, conversely, it is also possible to provide the engagement projection on the compressor impeller 1*a*, and to provide the engagement hole in the shaft 2.

In this case, as is shown in FIG. 5, the differential screw 3 penetrates to an even deeper position inside the shaft 2. Because of this, the differential screw 3 can be removed from that area (i.e., the maximum stress portion) on the internal wall portion of the through hole 1*f* that is provided inside the compressor impeller 1*a*, and the area corresponds to the maximum diameter portion of the compressor impeller 1*a*, which is where the load is greatest as a result of the stress being highest in the internal wall portion. Because of this, it is possible to decrease the load that acts on the differential screw 3. Moreover, by removing the differential screw 3 from the maximum stress portion of the compressor impeller 1*a*, a greater axial force can be applied to the compressor impeller 1*a*, so that the fastening force between the compressor impeller 1*a* and the shaft 2 can be increased.

Moreover, in the embodiments of the present invention, a structure that utilizes engagement projections and engagement holes, and also pin components are used in order to prevent any rotation between the compressor impeller 1*a* and the shaft 2 and to fix these in position. However, instead of this, it is also possible to use, for example, a curvic coupling.

Moreover, in the embodiments of the present invention, in order to prevent any loosening of the fastening force that is caused by the thermal expansion generated when the turbo compressor is in operation, it is also possible to impart sufficient axial force to the differential screw 3 to mitigate any loosening of the fastening force that is caused by thermal expansion.

Moreover, in the embodiments of the present invention, as is shown in FIG. 2, the differential screw 3 is provided with an engaging hole 3*c* in which the jig 10 is engaged.

However, the present invention is not limited to this, and it is also possible to provide an engaging projection on the differential screw 3 with which an engaging portion of the jig is able to engage instead of providing the engaging hole 3*c*.

Moreover, in the embodiments of the present invention, a turbo compressor that is provided with a single shaft and with the single compressor impeller 1*a* that is fastened to one end of this shaft is described.

However, the present invention is not limited to this. For example, the present invention can also be applied to turbo compressors in which compressor impellers 1*a* are fastened to both ends of a single shaft, turbo compressors that are provided with a plurality of shafts and in which a compressor impeller is provided for each shaft, and turbo compressors that are provided with other equipment such as coolers that cool the compressed gas.

INDUSTRIAL APPLICABILITY

According to the turbo machine of the present invention, an impeller and shaft are fastened together using a differential screw in which the thread diameter of the thread ridges that are formed on the impeller screw portion, in particular, is the same as the thread diameter of the thread ridges that are formed on the shaft screw portion. Because of this, it is no longer necessary to extend the length of the differential screw in order to alleviate the stress generated in the portion where the thread diameters are mutually different, as is the case conventionally. Accordingly, it is possible to suppress any increase in the amount of work that is caused by pretensioning.

REFERENCE SIGNS LIST

S1~S3 Turbo compressors (Turbo machine)
1 . . . Compressor
1*a* . . . Compressor impeller (Impeller)
1*b* . . . Compressor housing
1*c* . . . Base portion
1*d* . . . Blades
1*e* . . . Engagement hole
1*f* . . . Through hole
1*g* . . . Intake port
1*h* . . . Diffuser
1*i* . . . Scroll flow path
1*j* . . . Aperture portion

2 . . . Shaft
2*a* . . . Engagement projection
3 . . . Differential screw
3*a* . . . Impeller thread portion
3*b* . . . Shaft thread portion
3*c* . . . Engaging hole
4 . . . Drive unit
5 . . . Pin components (Rotation suppressing member)
6 . . . Engagement hole (Rotation suppressing member)
7 . . . Engagement projection (Rotation suppressing member)
9 . . . Nose cap (Cover)
10 . . . Jig

The invention claimed is:

1. A turbo machine that is provided with an impeller that is rotated, and with a shaft that transmits rotation power to this impeller, comprising:

a differential screw having an impeller screw portion that is provided at one end thereof and that is screwed into the impeller and a shaft screw portion that is provided at another end thereof and that is screwed into the shaft, and that fastens the impeller and the shaft together, and wherein, in the differential screw, a thread diameter of thread ridges that are formed on the impeller screw portion is formed the same as a thread diameter of thread ridges that are formed on the shaft screw portion, a screwing direction of the thread ridges that are formed on the impeller screw portion is formed as the same direction as a screwing direction of the thread ridges that are formed on the shaft screw portion, and a pitch between the thread ridges that are formed on the impeller screw portion is formed smaller than a pitch between the thread ridges that are formed on the shaft screw portion.

2. The turbo machine according to claim 1, wherein the impeller screw portion is longer than the shaft screw portion.

3. The turbo machine according to claim 1, wherein the impeller is provided with a through hole that extends along the axis of rotation thereof and that screws together with the impeller screw portion of the differential screw, and in an aperture portion of the through hole that is furthest from the shaft, a cover body that blocks off this aperture portion is removably provided.

4. The turbo machine according to claim 1, wherein the differential screw is formed from a material having a higher thermal conductivity than the impeller.

5. The turbo machine according to claim 4, wherein the impeller is formed from a titanium alloy, and the differential screw is formed from a steel material.

6. The turbo machine according to claim 1, further comprising a rotation suppressing member that suppresses rotational movement of the impeller relative to the shaft.

7. The turbo machine according to claim 6, wherein the rotation suppressing member are pin components that take the direction of the axis of rotation of the impeller as their longitudinal direction, and that are engaged in engagement holes that are provided at positions separated from the axis of rotation of the impeller, and in engagement holes that are provided at positions separated from the axis of rotation of the shaft.

8. The turbo machine according to claim 7, wherein a plurality of the pin components are arranged equidistantly in a circumferential direction centered on the axis of rotation of the impeller.

9. The turbo machine according to claim 6, wherein the rotation suppressing member has:

an engagement projection whose external shape when viewed from the direction of the axis of rotation of the impeller is offset from a circular shape, and that is provided in one of the impeller and the shaft protruding in the direction of the axis of rotation; and an engagement hole that is provided in the other one of the impeller and the shaft, and in which the engagement projection is engaged.

10. The turbo machine according to claim 9, wherein the engagement projection has a shape whose center of gravity is the axis of rotation.

11. The turbo machine according to claim 1, wherein the screwing direction of the thread ridges that are formed on the shaft screw portion is set to a direction that causes the fastening force between the differential screw and the shaft to be increased by the reaction force that is generated when the shaft is rotated.

12. The turbo machine according to claim 1, wherein an engaging hole or an engaging projection with which an engaging portion of the jig that rotates the differential screw is able to be engaged is provided in an end surface of the differential screw on the impeller side thereof, and a through hole that exposes the engaging hole or the engaging projection is provided in the impeller.

13. The turbo machine according to claim 12, wherein the engaging hole or the engaging projection with which the engaging portion of the jig that rotates the differential screw is able to be engaged has a shape whose center of gravity is the axis of rotation of the impeller.

* * * * *